US005630950A

United States Patent [19]

Cangelosi

[11] Patent Number: 5,630,950

[45] Date of Patent: May 20, 1997

[54] COPPER BRIGHTENING PROCESS AND BATH

[75] Inventor: Anthony R. Cangelosi, Clinton Township, Mich.

[73] Assignee: Enthone-OMI, Inc., Warren, Mich.

[21] Appl. No.: 322,109

[22] Filed: Oct. 11, 1994

Related U.S. Application Data

[63] Continuation-in-part of Ser. No. 89,856, Jul. 9, 1993, abandoned.

[51] Int. Cl.[6] ..... C09K 13/06

[52] U.S. Cl. ..... 216/106; 216/105; 252/79.2; 252/79.4

[58] Field of Search ..... 216/105, 106; 252/79.2, 79.4

[56] References Cited

U.S. PATENT DOCUMENTS

| | | | |
|---|---|---|---|
| 3,773,577 | 11/1973 | Shibasaki et al. | 252/79.4 |
| 4,022,703 | 5/1977 | Bakes et al. | 252/79.4 |
| 4,233,111 | 11/1980 | Valayil et al. | 252/79.4 |
| 4,238,279 | 12/1980 | Tsubai et al. | 252/79.2 |
| 4,308,091 | 12/1981 | Schmitt et al. | 252/79.4 |
| 4,376,057 | 3/1983 | Angelo et al. | 252/79.4 |
| 4,437,929 | 3/1984 | Wong | 252/79.4 |
| 4,518,519 | 5/1985 | Lott et al. | 252/148 |
| 4,767,661 | 8/1988 | Battey et al. | 252/79.2 |
| 4,859,281 | 8/1989 | Goltz | 252/79.4 |
| 4,875,972 | 10/1989 | Williams et al. | 252/79.2 |
| 4,880,495 | 11/1989 | Petraitis et al. | 252/79.2 |
| 5,030,373 | 7/1991 | Kimura et al. | 252/79.2 |
| 5,098,517 | 3/1992 | Tytgat et al. | 252/79.2 |

FOREIGN PATENT DOCUMENTS 57-155379 9/1988 Japan .

OTHER PUBLICATIONS

"GAF Polyvinylpyrrolidone Polymers" Brochure.

*Primary Examiner*—T. Tung

*Attorney, Agent, or Firm*—Harness, Dickey & Pierce, P.L.C.

[57] ABSTRACT

A process and aqueous bath for bright dipping of a copper containing substrate. The bath includes: an acid, hydrogen peroxide and a bath soluble, peroxide stable constituent effective for creation and stabilization of a dissolution inhibiting film over the brightened substrate.

31 Claims, 1 Drawing Sheet

COPPER BRIGHTENING PROCESS AND BATH

RELATED APPLICATIONS

This is a continuation in part of U.S. Ser. No. 08/089,856 Entitled Copper Brightening Process and Bath filed Jul. 9, 1993, now abandoned.

BACKGROUND OF THE INVENTION

The present invention relates to an improved chemical polishing bath for metal brightening. More specifically, the present invention relates to an improved composition and method for chemical polishing of copper and copper alloy substrates.

Chemical polishing or brightening of copper alloy substrates, electroplates and the like has been known in the art for preparing surfaces for further plating thereover and/or commercial grade polish. Typical bright dipping baths include mixtures of one or more acids such as concentrated sulfuric, phosphoric, nitric, hydrochloric, acetic and chromic acids. These baths, while having tendency to brighten the copper, are hard to control and result in unwanted etching of the copper if not utilized under strict process parameters.

In recent years, the use of hydrogen peroxide as an additive to acid brightening baths has greatly increased the stability and useability of these baths. However, hydrogen peroxide rapidly degrades in such acid solutions, and typically, such solutions typically include additives such as chelating agents and chromic acids which require special costly treatment of disposal. While these brightening baths provide superior brightening of copper substrates, they have a disadvantage in that the drag-out of chromic acid into the rinse bath is so great that at times parts will be etched in the rinse water. While other additives are known to provide advantageous brightening at reduced chromium levels, there still remains a need in the art for improvement through removal of chromic acid content, while providing better bath stabilization, improved levelling and reduced etching of parts, such that only high quality brightening is achieved.

SUMMARY OF THE INVENTION

In accordance with the present invention, there is provided a process and aqueous bath for bright dipping of a copper containing substrate. The bath of the present invention includes effective amounts of an acid, hydrogen peroxide and a bath soluble peroxide stable constituent effective for creation and stabilization of a dissolution inhibiting film over the brightened substrate.

The present invention provides superior leveling and brightening. The film created on the substrate produces a self-attenuating brightening process whereby less copper metal is removed from the substrate. Additionally, the present invention produces these superior levelling and brightening of substrates without the use of chromic acids, chelating agents or the like which present costly and problematic disposal problems.

Additional benefits and advantages of the present invention will become apparent upon review of the description of the preferred embodiments set forth below in view of the accompanying examples and the claims appended hereto.

DETAILED DESCRIPTION OF THE PREFERRED EMBODIMENTS

Figure 1:
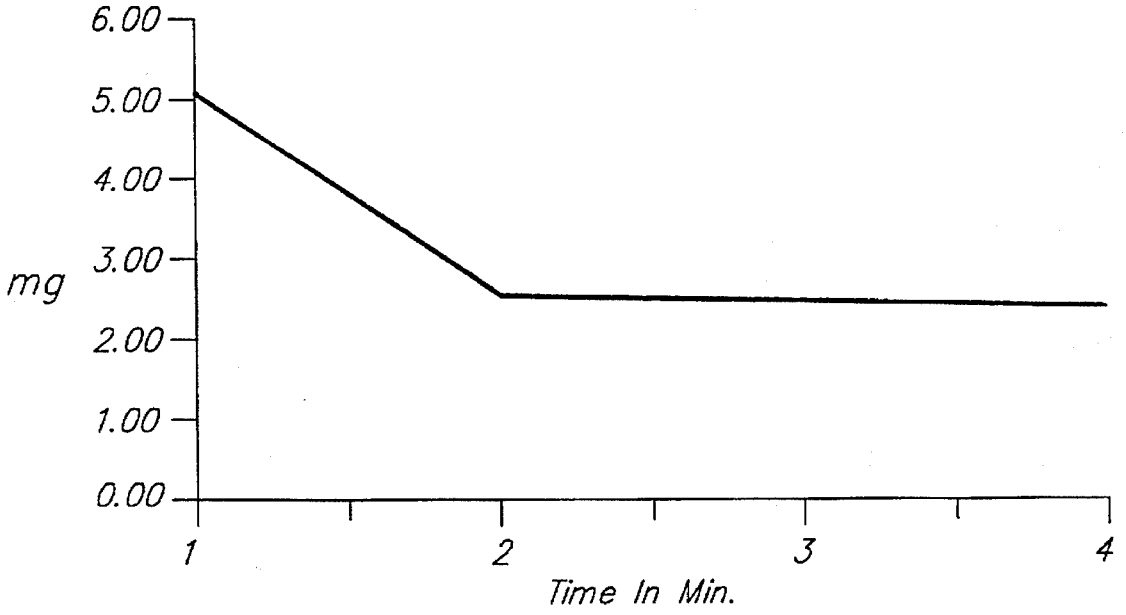
FIG. 1 is a graph demonstrating the self attenuation of the metal dissolution reaction as the dissolution inhibiting film forms.

Thus, in accordance with the present invention, there is provided a bath for bright dipping of copper which provides improved levelling and brightening of the substrate surface in a controlled manner, such that less of the substrate is consumed. Baths in accordance with the present invention include aqueous acid and peroxide brightening baths which also include a peroxide stable constituent, preferably a polymer, in an amount effective for creation and stabilization of a dissolution inhibiting film over the brightened substrate.

Baths of the present invention, generally comprise from about 1 g/l to about 35 g/l acid which typically ranges from about 2 g/l to about 12 g/l, and preferably from about 4 g/l to about 8 g/l of an acid. The acid utilized in the present invention is selected from commonly used acids such as sulfuric acids, hydrochloric acid, nitric acid, phosphoric acid and acetic acid which have been utilized in brightening baths in the past. Extremely corrosive acids such as hydrofluoric acid are not useful in the present invention, as they provide unacceptable rapid degradation of the substrate. A particularly preferred acid of the present invention is sulfuric acid which is utilized in the above percentages in its concentrated form. The use of hydrochloric and nitric acids, while effective, may be undesirable since these acids may be subject to liberation of chlorine gas or nitric oxide and nitrogen dioxide gases.

The peroxide component of the present invention is generally utilized in quantities of from about 45 g/l to about 230 g/l $H_2O_2$, typically from about 50 g/l to about 200 g/l, and preferably from about 60 g/l to about 175 g/l. Preferably, the peroxide of the present invention is added to the solution in the form of hydrogen peroxide, however, other peroxide sources may be used, but typically are not used because they are costly.

A critical constituent of the bath in the present invention is the peroxide stable constituent which forms the dissolution inhibiting film.

Generally, the peroxide stable constituent is a bath soluble non-polymeric pyrrolidone, a polyvinyl alcohol, or a polymer of a pyrrolidone or mixtures thereof.

In a first preferred embodiment bath soluble pyrrolidone is provided in the bath in effective quantities for the creation of a dissolution inhibiting film. Suitable pyrrolidones include N-methyl pyrrolidone, Cyclo hexyl pyrrolidone, N-Hydroxy Ethyl-2-pyrrolidone. Additionally, it is known that N-methyl pyrrolidone will break down in the presence of peroxide and acid in the bath to N-methyl succinate and maintain film forming properties. Thus, succinates are also useful in the baths of the present invention. By bath soluble herein it is meant that at least a concentration of 0.5% by weight of the composition must be in solution to provide dissolution inhibiting qualities. Typically, baths of the present invention will contain from about 5 to about 25 g/l of these non-polymerized pyrrolidones. Preferred quantities are from about 10 to about 22 g/l of the pyrrolidones.

Advantages of these non-polymeric pyrrolidone are that they do not break down as easily as some of the polymeric constituents (set forth below) in the peroxide containing baths. These baths can also be operated at higher temperatures to provide faster polishing times which may be desireable for commercial purposes. Additionally, the breakdown of peroxide is reduced by use of the non-polymeric pyrrolidones. Thus, less bath additions are required in commercial operation. However, the dissolution inhibiting film, while still commercially viable, is slightly less effective than that realized when using the polymer additive discussed below. In some cases while dissolution is inhibited the self attenuation characteristics are reduced or eliminated. However, etching of the substrate is avoided because of the protection of the film. Thus, this requires more attention to the polishing process in commercial applications.

A second preferred constituent is a polyvinyl polymer of a pyrrolidone, alcohol or acrylate. Polymers suitable in the present invention must be peroxide stable in that they do not break down in the presence of peroxide, and must be effective for the creation of a dissolution inhibiting film over the substrates as the substrate is brightened. Thus, by the term "peroxide stable" it is meant that the polymer will not significantly degrade over the useful brightening period of the bath. Additionally, the polymer to be utilized must be bath soluble. Preferred polymers also act to increase the viscosity of the solution. Polymers useful in the present invention generally have a molecular weight of from about 5,000 to about 2,000,000; with preferred molecular weights being in the range of about 10,000 to about 1,280,000. The preferred polymers for use in the present invention are added to the bath in an aqueous viscous solution. These solutions typically are viscous and have K-value viscosities in the range of from about 15 to about 120 which typically ranges from about 30 to about 60. A preferred polymer for use in the present invention is pyrrolidone polymer having a K-value in the range of about 20 to about 40. In particular, it is preferred that a polyvinyl pyrrolidone (PVP) in an aqueous solution having the above set forth viscosities and molecular weights is utilized. PVP's are particularly suitable for use in the present invention since they are produced in the presence of hydrogen peroxide. This makes them inherently stable in baths containing peroxides. Suitable PVP polymers are available from GAF Chemicals Corporation of Wayne, N.J. Additionally, an ISP polymer ACP-1021 PVP K-30, which includes hydrogen peroxide complexed in its structure, could also be used in the present invention without deviating from the scope of the invention. It is believed that other polymers such as polyvinyl alcohols (PVA) and acrylate polymers, may also be useful in the present invention, provided they operate in the bath as described above. A particular PVA which has been found useful is a Elvanol 90-50 Polyvinyl alcohol which can be obtained from E.I. du Pont de Nemours and Company, Wilmington, Del. 19898.

Polymer content in the baths of the present invention is generally from about 2 g/l to about 25 g/l. Typically, from about 5 g/l to about 20 g/l is utilized with preferred amounts of from about 8 g/l to about 16 g/l. These quantities reflect the amount of polymer alone in its solid form. However, the viscosity values set forth above are characteristic of polymers in an aqueous solution which are typically the form in which the polymers are added to the bath.

The films produced in accordance with the present invention are typically a reddish-brown color. Without wishing to be bound by theory, it is believed that the pyrrolidone, PVP or other polymers, form a loosely complexed or cross-linked coating on the surface which includes copper oxides or the like which have been removed from the surface, which would account for the reddish-brown color of the film. As the oxides are removed from the surface during brightening, it is believed that the polymer/oxide coating is formed, which builds up on the surface. As the film builds up on the surface, the active brightening ingredients are unable to reach the surface, inhibiting further dissolution of the base metal. This prevents undesirable etching of the base metal. Thus, the brightening process of the present invention is self-regulating whereby excess etching of the base metal from too long a dwell time, or the like, is substantially reduced, if not in fact avoided via the present invention. This is a great advantage for applications wherein process perimeters may not be closely watched or controlled. This allows for the brightening of parts with reduced concern with respect to over-etching of the parts.

In a preferred embodiment of the present invention, a surfactant is included for imparting anti-foam properties to the bath. The surfactant is preferably a block copolymer of propylene oxide and ethylene oxide. A particularly preferred surfactant is a pluronic L-42 surfactant. Other anti-foam agents could also be utilized, provided that they do not interfere with the advantageous characteristics of the bath. The surfactant may be provided in effective amounts of from about 0.01 g/l to about 5 g/l. Other suitable surfactants for use in the non-polymeric pyrrolidone baths include non-ionic and anionic surfactants which do not readily break down in the peroxide and acid baths of the present invention. Particularly suitable surfactants include Flourads® available from 3M, Minneapolis, Minn., and DOWFAX® surfactants available from Dow Chemical, Midland, Mich.

The baths of the present invention may be used to brighten any type of copper or its alloys such as zinc, brass, bronze or other copper containing metals although best performance is realized with 70/30 brass. Depending on the copper content of the metal to be brightened, the peroxide content should be varied. The peroxide should be generally utilized at higher levels as the copper level of the base substrate increases and may be used at lower levels to prevent de-zincification in alloys which include reduced quantities of copper. It should also be noted that the film formation of the present invention is slower as the copper content is increased. Thus, it may be desirable to provide longer bath dwell times or higher bath temperatures when brightening of alloys contain high quantities of copper. Additionally, when operating at higher levels of acid content it is also necessary to include higher levels of film forming polymers and/or higher temperatures.

Thus, in accordance with the process aspects of the present invention, a bath ,as formulated above, is provided in a quantity suitable for bright dipping of the copper alloy parts at hand. The copper containing substrate is then dipped in the bath for sufficient time to brighten the metal and form a dissolution inhibiting film over the substrate. Thereafter, in order to further process the metal or uncover the brightened bare metal surface, the film must be removed by immersion in a weak acid solution of, for instance phosphoric acid, in quantities from about 1% to about 5% by weight, which preferably is from about 2% to about 4% by weight. Typically, brightening baths of the present invention are operated at about 85° F. to about 130° F. Higher temperatures may be used with non-polymeric pyrrolidone. Preferred temperatures with the polyvinyl pyrrolidone are between 85° F. and 100° F. since the polymeric pyrrolidones tend to rapidly break down at temperatures above 100° F. Operation above about 110° F. tends to de-stabilize the hydrogen peroxide in the solution when using polymeric pyrrolidones. However when using non-polymeric pyrrolidones the hydrogen peroxide is more stable allowing baths to be operated at higher temperatures. Operation below about 85° F. may tend to slow down the brightening process, however, the bath would still provide effective brightening if the parts are given sufficient dwell time in the bath. Typically, dwell times in the baths for brightening of copper ranges from about 1 to about 10 minutes, with preferred ranges being from about 2 to about 5 minutes. It has been found that a 25% improvement in levelling over a scratch-polished part has been realized from merely a 5 minute exposure to the baths of the present invention. Additionally, baths of the present invention have a reduced BTU output which allows for a higher loading factor in the baths. A standard operating bath of the present invention, having a loading factor of 2.52 $ft^2$/gallon, was found to have a BTU output of <380 BTU/hour. Thus, baths of the present invention are capable of improved loading without boil- over problems.

In order to further illustrate the present invention, the following specific examples are provided. It will be understood that the examples as hereinafter set forth, are provided for illustrative purposes and are not intended to be limiting to the scope of this invention, as herein disclosed and as set forth in the subsequent claims.

EXAMPLE I

A 500 ml aqueous brightening bath was prepared using 30 g/l PVP (14 g/l solid PVP, obtained from GAF Chemicals) liquid having a K-value of 60 obtained from GAF, 200 g/l hydrogen peroxide (35% by weight) and 10 g/l reagent grade sulfuric acid. The bath temperature was maintained at room temperature. Clean brass plated parts were immersed in the bath and slow mechanical agitation was utilized. The parts developed a dissolution inhibiting, reddish-brown film after about 2 to about 3 minutes. Parts where thereafter rinsed in water and then dipped in a 2% to about 4% phosphoric acid solution to dissolve and remove the film. The process resulted in a highly reflective light colored brass surface which did not tarnish upon standing.

EXAMPLE II

An aqueous brightening bath additive having a volume of 100 gallons is prepared utilizing 413 pounds PVP (peregal ST), 2.1 pounds pluronic L-42 surfactant, and the remainder water. To a commercial sulfuric acid and peroxide brightening bath is added 5% by volume of the additive. The bath is maintained at room temperature. Copper plated parts are immersed in the solution. The solution is mechanically agitated and the parts are left in the bath for an extended period of time. A dissolution inhibiting, reddish-brown film is formed within about 3 to about 5 minutes. The completed brightened parts are immersed in about a 2% to about 4% phosphoric acid solution to remove the reddish-brown film and are found to have good levelling and superior brightening without excessive removal of metal. The example is repeated using 10% by volume of the additive, with the same results.

EXAMPLE III

A 500 ml brightening bath was prepared consisting of 82.772% by weight water; 1.144% by weight $H_2SO_4$; 11.14% by weight hydrogen peroxide (100% $H_2O_2$); 4.92% by weight polyvinyl pyrrolidone and 0.024% by weight of a block copolymer of propylene oxide and ethylene oxide.

The bath was heated to 90° F. and a +586 mv potential was measured with a platinum and silver/silver chloride ORP probe.

Two 16 gage copper wires of equal weight (1.8243 grams) and length (6.5") were immersed in the bright dip bath. Both wires were exposed to the bath solution for the first 7 minutes, at the same time, to eliminate variations which may be due to the bath chemistry. The second wire was removed after 14 minutes. The two wires were then de-smutted, dried and re-weighed. The average dissolution rate was 4.67 mg/min for the first 7 minutes. Over the next 7 minutes, the dissolution rate was found to be 3.55 mg/min. Thus, the dissolution rate was 24% slower in the last 7 minutes of exposure. Both the copper wire surfaces were bright and reflective without any etching.

EXAMPLE IV

A 500 ml polishing bath was made as follows: 150 ml (30% by volume) of hydrogen peroxide (35% by weight $H_2O_2$); 4 grams of sulfuric acid (8 g/l); 7.92 grams (15.84 g/l) of polyvinyl pyrrolidone with an average molecular weight of about 40,000 to 60,000; 0.126 g (0.25 g/l) of a block copolymer of propylene oxide and ethylene oxide; the remaining volume was made up with deionized water and the bath was heated to 85° F.

Brass buttons of 15/16" diameter with a 1/16" lip made of an Olin H-260 brass alloy (70% copper and 30% zinc) having an average weight of 0.6469 g were processed.

The process included a mild alkaline precleaning and rinse and a post rinse with 1% to about 4% phosphoric acid to remove the metal oxide/polymer film, then a rinse, and finally a forced air drying.

A 125 piece load was placed in a plastic screened basket and immersed into the bath and was shaken and moved up and down in the solution to help expose all the parts to the solution. After 5 minutes, the temperature rose from 93.3° F. to 97° F. The beaker was open on the top and bottom, and the sides were insulated with 0.5 inches of styrofoam. The total dissolution weight loss was 1.8693 grams. The average weight loss was 0.0145 g/piece. The consumption of sulfuric acid was 3.576 grams, determined by titration. The pH changed from 2.18 to 3.0. The hydrogen peroxide loss was 1.58% from the original 30% by volume.

For the next load of 25 pieces, sulfuric acid was added to a 7.54 g/l level. The temperature was from 90° F. to about 100° F. After 5 minutes, the total weight loss was 0.385 grams, with an average loss of 0.0154 g/piece.

Sulfuric acid was added after each load to maintain about 7 g/l to about 8 g/l concentration. About 350 pieces were processed before the end of the day. There was a gradual increase in metal dissolution rate from 0.015 g/piece to about 0.035 g/piece, as the hydrogen peroxide was consumed down to a 21.8% by volume level. The bath was allowed to cool and sit overnight. In the morning, the peroxide content was 20.5% by volume.

The bath was worked in the same manner until 250 more pieces were processed. The 35% by weight hydrogen peroxide was found to be 13.8% by volume. A higher dissolution rate of 0.056 g/piece was realized and was trouble forming a stable oxide film. This resulted in some etching on the lip of the buttons. This was especially true of the Olin J-230 brass alloy (85% copper and 15% zinc) which needed about 25% by volume hydrogen peroxide where the 70/30 brass required about 15% by volume to about 12% by volume to operate without etching. To this same bath, hydrogen peroxide was added to boost the concentration to 25% by volume and 150 more pieces were processed without etching.

This example demonstrates that a chemical polishing bath can be made and operated well by controlling the sulfuric acid content and monitoring the temperature through a wide range of hydrogen peroxide levels.

EXAMPLE V

A bath was prepared using 6 g/l reagent grade sulfuric acid (30% by volume); a 35% by weight hydrogen peroxide solution; and 10% by volume of an additive which was prepared in accordance with Example I.

The bath was heated and maintained at a temperature of from about 85° F. to about 90° F. A 70% copper and 30% zinc, twelve square inch surface area hull cell panel was placed in the bath and the weight loss was noted as set forth in Table 1.

TABLE 1

DISSOLUTION OF BRASS PANEL FOR HULL CELL

| Part Tested | Time Min. | Wt Loss | Wt/Min. | Wt/Min/In$^2$ | MV |
|---|---|---|---|---|---|
| 12 in$^2$ 70/30 brass | 1 | 59.90 | 59.90 | 4.99 | 580.2 |
| | 1 | 75.20 | 75.20 | 6.27 | 580 |
| | 1 | 61.00 | 61.00 | 5.08 | 580.2 |
| | 2 | 60.70 | 30.35 | 2.53 | 580 |
| | 3 | 88.60 | 29.53 | 2.46 | 580 |
| | 4 | 112.60 | 28.15 | 2.35 | 580 |

The results are set forth in the graph of FIG. 1. As can be readily appreciated from the graph, the dissolution rate slows down substantially after about 2 minutes into the process. This coincides with the formation of the film on the hull cell surface.

EXAMPLE VI

Various aqueous brightening baths are prepared in 500 ml quantities as follows:

1 g/l sulfuric acid; 45 g/l $H_2O_2$; 2 g/l PVP 2 g/l sulfuric acid; 50 g/l $H_2O_2$; 5 g/l PVP 4 g/l sulfuric acid; 60 g/l $H_2O_2$; 8 g/l PVP 8 g/l sulfuric acid; 175 g/l $H_2O_2$; 16 g/l PVP 12 g/l sulfuric acid; 200 g/l $H_2O_2$; 20 g/l PVP 35 g/l sulfuric acid; 230 g/l $H_2O_2$; 25 g/l PVP These solutions are prepared with 0.1% by weight surfactant. The solutions are found useful to form brightened metals with dissolution inhibiting layers thereover. The example is repeated utilizing various viscosities of PVP polymer solutions ranging from K-15 to K-120, and are found to form dissolution inhibiting films.

EXAMPLE VII

A 500 ml bath was made by dissolving 2.5 grams of Elvanol 71-30 (a polyvinyl alcohol made by DuPont) into 350 ml of hot water with 3 grams of sulfuric acid reagent grade. The bath was cooled to 100° F. and then 161 grams of hydrogen peroxide (35% by weight) was added to the bath. The PVA used was not completely dissolved, more soluble forms of PVA having more acetate groups hydrolyzed would make a more viscous bath possible, which would be beneficial. A 12 in$^2$ 70/30 Brass Panel was immersed into the bath for 5 minutes, and the weight loss was recorded. Thereafter, 1 gram of acid was added to the bath and the same panel was immersed again. This pattern was continued until etching occurred. The results are set forth below.

| Wt/vol. of Acid Added | Time Exposed | Total Wt. Loss | mg/min/in$^2$ |
|---|---|---|---|
| 6 g/l | 5 minutes | 0.1354 grams | 2.25 |
| 8 g/l | 5 minutes | 0.2572 grams | 4.29 |

-continued

| Wt/vol. of Acid Added | Time Exposed | Total Wt. Loss | mg/min/in$^2$ |
|---|---|---|---|
| 10 g/l | 6 minutes | 0.4001 grams | 5.56 |
| 12 g/l | 5 minutes | 0.3148 grams | 5.24 |
| 14 g/l | 6 minutes | 0.3465 grams | 4.81* |
| 17 g/l | 5 minutes | 0.3868 grams | 6.44** |

*5 ml of bath titrated to pH of 4 with 8.4 ml of 0.1N NaOH.

**The panel placed vertical in the beaker was etched ¾" up from the bottom of the panel.

75% of the panel had a polished finish.

The film formed more difficulty as the acid was increased. The bath dissolved 3.68 g/l of brass. Out of the 17 g/l acid added only 12 g/l remained as free acid. The peroxide dropped 7% from the original level, 112.7 g/l to 104 g/l. Sitting for 13 hours the peroxide dropped only 2% (102 g/l). The bath gassing was minimal compared to PVP with more than twice the dissolved solids.

EXAMPLE VIII

A 500 ml bath was prepared as set forth below in Table II.

TABLE II

| Constituents | Quantity |
|---|---|
| hydrogen peroxide (35%) | 140 ml |
| polyvinyl alcohol* | 50 ml |
| water | 310 ml |
| sulfuric acid (66° Be') | 4 g |
| ph | 2.0 |
| surface tension | 51 dynes/cm$^2$ |

*Elvanol 70-30 (4% aqueous solution)

The bath was tested for dissolution inhibiting film using a copper disc having a diameter 2¼" with a surface area of 14 square inches. The bath was raised to a temperature of 105° F. The disc was immersed in the bath and weighed after 1 minute and then again after 2 minutes. The weight loss after 1 minute was found to be 0.0304 g/min and weight loss after 2 minutes was found to be 0.0636 g/min. A dissolution inhibiting, reddish brown film is formed within about ½ to about 1 minute. The finished part has an improved reflective surface.

EXAMPLE IX

A 500 m/l polishing bath was prepared as set for in Table III:

TABLE III

| | |
|---|---|
| 35% hydrogen peroxide | 140 ml |
| polyvinyl alcohol* | 50 ml |
| water | 310 ml |
| sulfuric acid (66° Be') | 5 g |
| pH | 2.103 |
| surface tension | 67 dynes/cm$^2$ |

*Elvanol 90-50 (5.4 g/l solution)

The dissolution test was again done using a copper disc 2¼" in. in diameter having an area of 14 square inches. In this test the weight loss permitted in the first minutes was 0.0616 g/min and after 2 minutes was 0.1738 g/min a reddish brown dissolution inhibiting film is noted after about ½ to 1 minute interval. The finished part provides an improved reflective finish.

EXAMPLE X

A 500 ml polishing bath is prepared as set forth in Table IV:

TABLE IV

| Constituents | Quantity |
|---|---|
| hydrogen peroxide (35%) | 140 ml |
| polyvinyl alcohol* | 50 ml |
| water | 310 ml |
| sulfuric acid (66° Be') | 4 g |
| pH | 2.023 |
| surface tension | 51 dynes/cm$^2$ |

*Elvanol 51-05 (4% solution)

A dissolution test was accomplished with a copper disc 2¼" in. in diameter having an area of 14 square inches. The bath was raised to a temperature of 105° F. The weight loss per minute after 1 minute is 0.0595 grams and after 2 minutes is 0.0784 g/min. A reddish brown dissolution inhibiting film is noted after about ½ to 1 minute. The finished part has an improved reflective surface.

EXAMPLE XI

A 500 ml polishing bath was prepared with the constituents as set forth in Table V.

TABLE V

| Constituents | Quantity |
|---|---|
| hydrogen peroxide | 140 ml |
| N-methyl pyrrolidone | 5.9 ml |
| water | 310 ml |
| sulfuric acid (66° Be') | 4 g |
| pH | 2.06 |
| surface tension | 67 dynes/cm$^2$ |

A dissolution test was accomplished using a copper disc 2¼" in. in diameter having an area of 14 square inches. The bath was raised to a temperature of a 105° F. when the copper was immersed therein. After 1 minute of immersion the weight loss was 0.0654 g/min. After 2 minutes at temperature of the weight loss was 0.0772 g/min. A reddish brown dissolution inhibiting film is found to form after about ½ to 1 minute. The copper disc had an improved reflective surface.

EXAMPLE XII

A 750 ml polishing bath was prepared as set forth in Table VI:

TABLE VI

| Constituents | Quantity |
|---|---|
| hydrogen peroxide (35%) | 200 ml |
| N-methyl pyrrolidone | 3.75 ml |
| benzotriazol | .375 g |
| water | 545 ml |
| sulfuric acid (66° Be') | 13 g |

A dissolution test was accomplished by using a 70-30 brass plate the dissolution rate was found to be 9.25 ml per in$^2$ per minute. A reddish brown dissolution inhibiting film was noted on the part after about ½ to 1 minute. The bath is tested and found to contain N-methyl succinate. The brass plate was highly polished upon completion of polishing.

While benzotriazol (a known copper tarnish inhibitor) had no affect on the formation of the film other agents such as aminotriazol seem to inhibit film formation.

EXAMPLE XIII

A 900 ml bath is prepared in a 1000 ml beaker using 30% by volume 35% peroxide, 10 grams of cyclo hexyl pyrrolidone, 8.6 g 66°Be' Sulfuric acid and the remainder water. The bath was raised to a temperature of 120° F. A 6.5 inch long 12 gauge copper wire is immersed in the solution in a first test. In a second test a 9 square inch panel was immersed in the bath. A reddish-brown dissolution inhibiting film was found to form after about ½ to 1 minute. The part was found to be polished with no etching after about 2 to 3 minutes.

EXAMPLE XIV

A 900 ml bath is prepared in a 1000 ml beaker using 30% by volume 35% peroxide, 10 grams of N-hydroxy ethyl 2 pyrrolidone, 8.6 g 66°Be' Sulfuric acid and the remainder water. The bath was raised to a temperature of 120° F. A 6.5 inch long 12 gauge copper wire is immersed in the solution in a first test. In a second test a 9 square inch panel was immersed in the bath. A reddish-brown dissolution inhibiting film was found to form after about ½ to 1 minute. The part was found to be polished with no etching after about 2 to 3 minutes.

It is to be understood that the above description and examples of the preferred embodiments are not to be limiting to the present invention. The present invention can be practiced otherwise than as specifically disclosed above, as it will be readily appreciated by those skilled in the art. Thus, it is appreciated that the invention is susceptible to modification, variation and change without departing from the proper scope and fair meaning of the accompanying claims.

What is claimed is:

1. An aqueous copper brightening bath comprising:

an acid and a peroxide In effective amounts in water to provide brightening of a copper containing substrate; and a bath soluble, peroxide stable constituent effective for formation of a dissolution inhibiting film upon brightening of the substrate thereby providing for substantially self-attenuating of the dissolution of the substrate after brightening of the substrate.

2. The bath of claim 1 wherein said constituent is selected from the group consisting of a source of bath soluble non-polymeric pyrrolidone, succinates, polymers of pyrrolidones, alcohols, and acrylates, and mixtures thereof.

3. The bath of claim 2 wherein the pyrrolidone polymer is a polyvinyl pyrrolidone.

4. The bath of claim 3 wherein the polyvinyl pyrrolidone has a molecular weight of from about 10,000 to about 1,280,000.

5. The bath of claim 3 wherein the polyvinyl pyrrolidone has a K-value viscosity at 25° C. of from about K-15 to about K-90.

6. The bath of claim 2 wherein the alcohol polymer is polyvinyl alcohol.

7. The bath of claim 1 wherein the bath soluble peroxide stable constituent is selected from the group consisting of N-methyl pyrrolidone, cyclo hexyl pyrrolidone, N-hydroxy ethyl-2-pyrrolidone, N-methyl succinate and mixtures thereof.

8. The bath of claim 1 wherein said bath soluble peroxide stable constituent is N-methyl pyrrolidone.

9. A process for bright dipping of a copper containing substrate comprising the steps of:

a) providing an aqueous bath comprising from about 1 g/l to about 35 g/l of an acid, from about 45 g/l to about 230 g/l of a peroxide, and from about 2 g/l to about 25 g/l of a peroxide stable constituent effective for creation and stabilization of a dissolution inhibiting film over a brightened substrate; and b) immersing a copper containing substrate into a bath for a sufficient time to brighten the metal and form a dissolution inhibiting film over the substrate and providing for self-attenuation of the dissolution of the substrate after brightening of the substrate.

10. The process of claim 9 wherein said constituent is selected from the group consisting of a source of a bath soluble non-polymeric pyrrolidone, succinates, pyrrolidone polymers, alcohol polymers, acrylate polymers, and mixtures thereof.

11. The process of claim 10 wherein said polymer is a polyvinyl pyrrolidone polymer.

12. The process of claim 11 wherein said polymer has a molecular weight of from about 10,000 to about 1,280,000.

13. The process of claim 11 wherein said polymer has a K-value viscosity at 25° C. of from about K-15 to about K-90.

14. The process of claim 10 wherein said polymer is a polyvinyl alcohol.

15. The process of claim 9 wherein said acid is selected from the group consisting of sulfuric acid, hydrochloric acid, nitric acid, and phosphoric acid.

16. The process of claim 9 wherein said peroxide is provided in the form of hydrogen peroxide.

17. The process of claim 16 further comprising the step of dipping said brightened substrate into a bath of phosphoric acid for removal of said film.

18. The process of claim 17 wherein the concentration of phosphoric acid in said bath is from about 1% by weight to about 4% by weight.

19. An aqueous brightening bath for brightening of a copper containing substrate, comprising from about 1 g/l to about 35 g/l of an acid; from about 45 g/l to about 230 g/l hydrogen peroxide; and from about 2 g/l to about 25 g/l of a polyvinyl polymer effective for formation of a dissolution inhibiting film over the substrate during brightening thereof which acts to substantially self-attenuate the dissolution reaction after brightening of the copper containing substrate.

20. The aqueous brightening bath of claim 19 wherein said polyvinyl polymer is selected from the group consisting of polyvinyl pyrrolidone, polyvinyl alcohol and mixtures thereof.

21. The bath of claim 20 wherein the polymer is added to the bath by way of an aqueous solution of the polymer having a K-value viscosity at 25° C. of from about K-15 to about K-90.

22. The bath of claim 21 wherein the viscosity at 25° C. of said polymer solution when added to the bath is from about K-30 to about K-60.

23. The bath of claim 20 wherein said polyvinyl pyrrolidone polymer and peroxide constituents may be provided in the form of a polyvinyl pyrrolidone complexed with a hydrogen peroxide.

24. The bath of claim 19 wherein the polymer has a molecular weight of from about 10,000 to about 1,280,000.

25. The bath of claim 19 wherein the acid is selected from the group consisting of sulfuric acid, hydrochloric acid, nitric acid, and phosphoric acid.

26. An aqueous brightening bath for brightening of a copper containing substrate comprising from about 1 g/l to about 35 g/l of an acid, from about 45 g/l to about 230 g/l hydrogen peroxide, at least 0.5% by weight of a non-polymeric pyrrolidone or succinate effective for formation of a dissolution inhibiting film over the substrate during brightening thereof which acts to substantially self-attenuate the dissolution reaction after brightening of the copper containing substrate.

27. The aqueous brightening bath of claim 26 wherein the source of non-polymeric pyrrolidone is selected from the group consisting of N-methyl pyrrolidone, cyclo-hexyl pyrrolidone, n-hydroxy ethyl-2-pyrrolidone, N-methyl succinate and mixtures thereof.

28. The aqueous brightening bath of claim 26 wherein the source of non-polymeric pyrrolidone is N-methyl pyrrolidone.

29. The aqueous brightening bath of claim 26 wherein said succinate is N-methyl succinate.

30. The brightening bath of claim 26 wherein the non-polymeric pyrrolidone is from about 5 g/l to about 25 g/l.

31. The brightening bath of claim 26 wherein the non-polymeric pyrrolidone is from about 10 g/l to about 22 g/l.

* * * * *

UNITED STATES PATENT AND TRADEMARK OFFICE

CERTIFICATE OF CORRECTION

PATENT NO. : 5,630,950

DATED : May 20, 1997

INVENTOR(S) : Anthony R. Cangelosi

It is certified that error appears in the above-indentified patent and that said Letters Patent is hereby corrected as shown below:

Column 1, Line 29, delete 2nd occurrence of "typically".

Column 2, Line 47, "Cyclo" should be --cyclo--.

Column 2, Line 48, "N-Hydroxy Ethyl-2-pyrrolidone" should be --N-hydroxy ethyl-2-pyrrolidone--.

Column 2, Line 59, "pyrrolidone" should be --pyrrolidones--.

Column 3, Line 44, "Polyvinyl" should be --polyvinyl--.

Column 4, Line 36, "contain" should be --containing--.

Column 4, Line 41, "bath ,as" should be --bath, as--.

Column 4, Line 53, "pyrrolidone" should be --pyrrolidones--.

Column 5, Line 28, "where" should be --were--.

Column 6, Line 50, after "and" insert --there--.

Column 7, Line 55, "Brass Panel" should be --brass panel--.

Column 8, Line 13, "difficulty" should be --difficultly--.

UNITED STATES PATENT AND TRADEMARK OFFICE

CERTIFICATE OF CORRECTION

PATENT NO. : 5,630,950

DATED : May 20, 1997

INVENTOR(S) : Anthony R. Cangelosi

It is certified that error appears in the above-indentified patent and that said Letters Patent is hereby corrected as shown below:

Column 8, Line 32, "ph" should be --pH--.

Column 8, Line 49, "for" should be --forth--.

Column 8, Line 52, insert headings: --Constituents-- above first column;
and --Quantity-- above second column.

Column 8, Line 62, delete "in.".

Column 8, Line 63, "minutes" should be --minute--.

Column 9, Line 17, delete "in.".

Column 9, Line 39, delete "in.".

Column 9, Line 40, delete "a". (second occurrence)

Column 9, Line 42-43, delete "at temperature of".

Column 9, Line 63, "plate" should be --plate;--.

UNITED STATES PATENT AND TRADEMARK OFFICE

CERTIFICATE OF CORRECTION

PATENT NO. : 5,630,950

DATED : May 20, 1997

INVENTOR(S) : Anthony R. Cangelosi

It is certified that error appears in the above-indentified patent and that said Letters Patent is hereby corrected as shown below:

Column 9, Line 65, "is" should be --was--.

Column 10, Line 39, Claim 1, "In" should be --in--.

Signed and Sealed this

Tenth Day of March, 1998

*Attest:*

*Attesting Officer*

Bruce Lehman

BRUCE LEHMAN

*Commissioner of Patents and Trademarks*